United States Patent [19]

Niegl et al.

[11] Patent Number: 4,975,552

[45] Date of Patent: Dec. 4, 1990

[54] VACUUM SWITCH

[75] Inventors: Manfred Niegl, Regensburg; Wilhelm Schels, Laaber; Rainer Behrend, Regensburg, all of Fed. Rep. of Germany

[73] Assignee: Sachsenwerk Aktiengesellschaft, Regensburg, Fed. Rep. of Germany

[21] Appl. No.: 499,688

[22] Filed: Mar. 27, 1990

[30] Foreign Application Priority Data

Apr. 3, 1989 [DE] Fed. Rep. of Germany ... 8904071[U]

[51] Int. Cl.[5] ..... H01H 33/66

[52] U.S. Cl. ..... 200/144 B

[58] Field of Search ..... 200/144 B

[56] References Cited

U.S. PATENT DOCUMENTS 3,562,457 2/1971 Peek ..... 200/144 B

FOREIGN PATENT DOCUMENTS 0241814 10/1987 European Pat. Off. .

*Primary Examiner*—Robert S. Macon

*Attorney, Agent, or Firm*—Spencer & Frank

[57] ABSTRACT

A vacuum switch which has a housing for a vacuum chamber. The housing includes a metal cylinder and an insulating cylinder axially aligned and hermetically sealed at adjacent ends, and closed at opposite ends by end walls. A stationary electrode and a movable electrode are provided in the vacuum chamber, surrounded by the metal cylinder. Stationary and movable electrode lead rods are fixed to the respective electrodes and project in opposite directions from the chamber through the end walls. A magnetic coil whose coil body is molded in an approximately bell-shape and is made of an electrically and thermally conductive material, surrounds the metal cylinder with a winding that is connected by way of an input lead with the electrode lead rod penetrating the end wall closing an end of the metal cylinder. A relatively thick top portion of the coil body is disposed above the end wall and has a rounded upper end, while a less thick cylindrical side wall surrounds the metal cylinder and has a rounded lower end. The winding is connected by way of an output lead with a connecting surface adjacent to the metal cylinder. The input and output leads are provided within the top portion, and in the preferred embodiment are integrally formed therein with a gap separating them so as to direct a portion of the operating current at the input lead around the metal cylinder through the side wall portion of the coil body, before reaching the connecting face.

16 Claims, 3 Drawing Sheets

VACUUM SWITCH

REFERENCE TO RELATED APPLICATIONS

This application claims the priority of Federal Republic of Germany application Ser. No. G 89 04 071.6 filed Apr. 3rd, 1989, which is incorporated herein by reference.

BACKGROUND OF THE INVENTION

The invention relates to a vacuum switch of the type which is typically used as part of a circuit breaker.

More particularly, the invention relates to a vacuum switch which has a housing for a vacuum chamber, the housing including a metal cylinder and an insulating cylinder which are axially aligned and hermetically sealed at adjacent ends, as by a soldered flange. Opposite ends of the housing are closed by end plates. A stationary electrode and a movable electrode in the vacuum chamber are surrounded by the metal cylinder. Stationary and movable lead rods are fixed to the respective electrodes and project in opposite directions from the chamber through the respective end plates. A magnetic coil whose coil body surrounds the metal cylinder with a winding which is connected via an input terminal lead with the lead rod extending through the end plate closing the end of the metal cylinder and is connected via an output terminal lead with a connecting point adjacent the metal cylinder, for connection to other circuit elements. Such a switch is disclosed in European published patent application No. EP 0,241,814.A2 and is illustrated in FIG. 1.

The prior art interrupter switch shown in FIG. 1 has a vacuum envelope 1 in which disc-shaped stationary and movable electrodes 2 and 3 are disposed and operable for forming or interrupting electrical contact therebetween. The vacuum envelope 1 includes an insulating cylinder 4, a disc-shaped metal end wall or plate 5 hermetically secured to one edge of the insulating cylinder 4 via a metal seal ring 6, a metal cylinder 7 having a flat bottom wall **7*a* and an open end hermetically secured to the other edge of the insulating cylinder 4 via another metal seal ring 6'. The stationary and movable electrodes 2 and 3 are located within the metal cylinder 7**.

A stationary lead rod 9 passes hermetically through, and is fixed to the flat bottom end wall **7*a*. An inner end of the stationary lead rod 9 carries the stationary electrode within the metal cylinder 7. On the other hand, a movable lead rod 10 passes loosely through the metal end plate 5 and is hermetically secured to the end plate 5 via a metal bellows 11. An inner end of the movable lead rod 10 carries the movable electrode 3 within the metal cylinder 7**.

A sharp-edged, uniformly thin-walled coil 13 of substantially one turn surrounds the stationary and movable electrodes 2 and 3 outside the metal cylinder 7. The coil 13 produces an axial magnetic field running parallel to the arc current path between the separated stationary and movable electrodes 2 and 3 for dispersing the arc evenly across the opposing faces of the electrodes, thereby increasing the current interruption performance of the interrupter switch. One end **13*a* of the coil 13 is electrically connected by a radially extending terminal lead (not shown in FIG. 1) to an outer end of the stationary lead rod 9. The other end 13*b* of the coil 13 is electrically connected by another radially extending terminal lead (not shown in FIG. 1) to one end of an outer lead rod 14 which is located outside of the vacuum envelope 1. An outer lead rod 15, also located outside the vacuum envelope 1, has a slide contact 16 at one end which mechanically and electrically engages an outer end of the movable lead rod 10**.

In operation, an operating current (e.g. a fault current) passes through the sequence comprising the outer lead rod 14, one terminal lead (not shown), the coil 13, the other terminal lead (not shown), the stationary lead rod 9, the stationary electrode 2, the arc current path between the stationary electrode 2 and the movable electrode 3, the movable electrode 3, the movable lead rod 10, the slide contact 16 and the outer lead rod 15, and vice versa.

Such prior art switches are disadvantageous for dissipating the heat from the vacuum switching chamber since the sharp-edged cylindrical, uniformly thin-walled shape of the coil itself and long radially extending terminal leads create excessive heat and do not efficiently dissipate the heat. Moreover, the sharp edges of the coil are also disadvantageous for insulating the vacuum switch from switches of adjacent phases and against the grounded basic frame of the switch gear.

SUMMARY OF THE INVENTION

It is an object of the invention to configure the coil in a vacuum switch of the above described type in such a way that, when charged with the operating current, the coil heats up as little as possible and particularly effectively dissipates the heat to the environment, with an optimum voltage stability resulting between the coils of adjacent switches and between the coil and ground potential.

This object is accomplished according to the invention by providing the coil body as a molded, approximately bell-shaped member made of an electrically and thermally highly conductive material, wherein the top of the bell-shaped member is above the end plate which closes the metal cylinder, the remainder of the bell-shaped member surrounds the metal cylinder, the input and output terminal leads are formed within the boundaries of the top of the bell-shaped member, the wall thickness of the coil body is thicker at the top (in the region of the input and output terminal leads) than in the portion surrounding the metal cylinder, and the upper and lower ends of the coil body are rounded.

BRIEF DESCRIPTION OF THE DRAWINGS

These and other features and advantages of the invention may be more completely understood from the following detailed description of the preferred embodiments of the invention with reference to the accompanying drawings in which.

DETAILED DESCRIPTION OF THE PREFERRED EMBODIMENT

Figure 1:
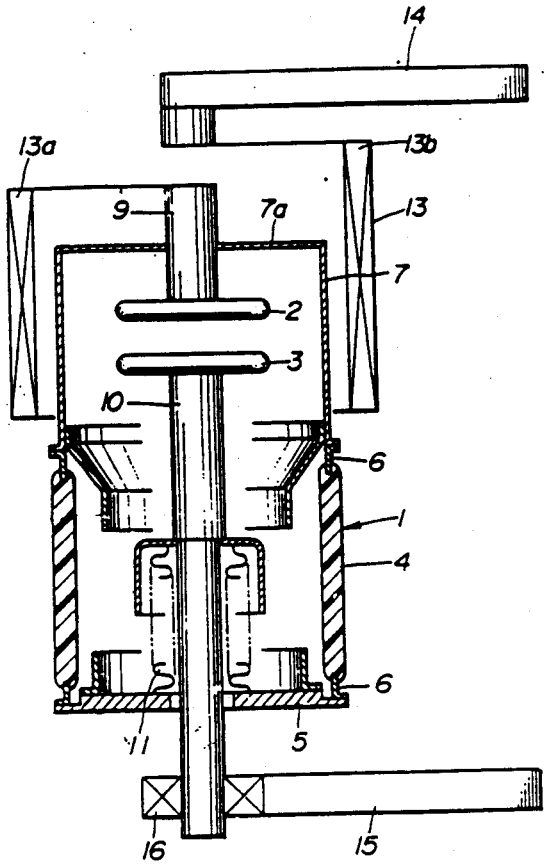
FIG. 1 (PRIOR ART)
FIG. 1 is a longitudinal sectional view of a vacuum switch according to the prior art.
Figure 2:
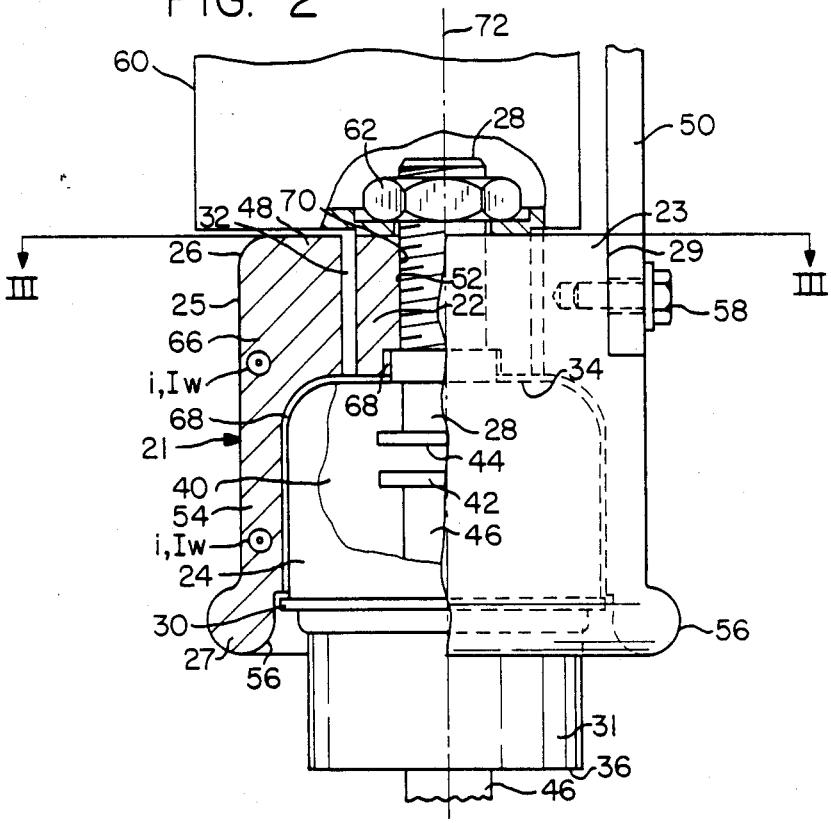
FIG. 2 is a front view partially in section, of a vacuum switch according to the invention.
Figure 3:
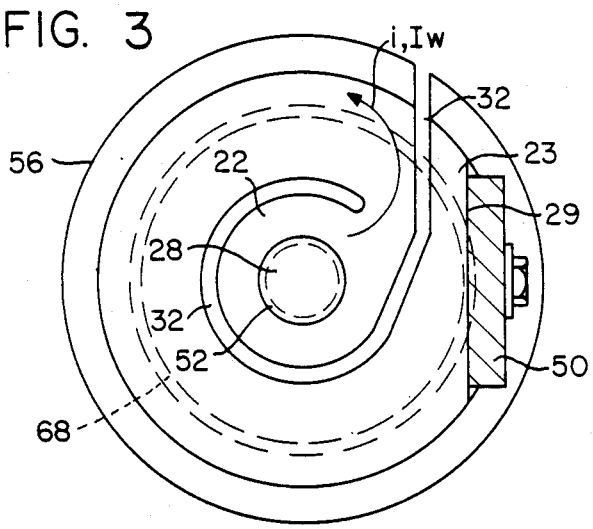
FIG. 3 is a top view of the vacuum switch shown in FIG. 1, taken along the line III—III in FIG. 2.

Referring to FIGS. 2 and 3, the vacuum switch according to the invention includes a metal cylinder 24 and an insulating cylinder 31 joined together at a sharp-edged soldered flange 30 and closed by end walls or plates 34 and 36 at opposite ends to define a vacuum chamber 40 therein. The current path of the vacuum switch includes a magnetic coil or coil body 21 which surrounds metal cylinder 24 in spaced relation thereto. The coil body 21 has an axis 72 and is molded as a bell-shaped coil body so as to have a bell-shaped peripheral surface (jacket) 25. The coil body 21 is made of copper or some other material having good electrical and thermal conductivity. A movable electrode 42 and a stationary electrode 44 are provided on the axis 72 in the portion of the chamber 40 surrounded by metal cylinder 24, and are respectively fixed to a stationary lead rod 28 and a movable lead rod 46. The movable lead rod 46 passes axially through the end wall 36 and is hermetically sealed thereto by means not shown such as a metal bellows. The stationary lead rod 28, which has a threaded upper portion, passes axially through the end wall 34 and the coil body 21, and is fixed by a nut 62 to the portion 22 of the coil body 21 so as to fix the respective portions of the coil body 21 and the metal cylinder 24 with an air space 68 therebetween, thereby isolating the coil body 21 from the metal cylinder 24.

An input terminal lead or lead portion 22, having an axially extending, partially threaded hole 70, and threadedly connected at 52 with an upper portion of the stationary lead rod 28, is formed integrally with a thick-walled top or base portion 48 of coil body 21. The input terminal lead 22 is separated by a vertical slot or gap slot 32 from a cylindrical peripheral portion 66 of the coil body 21 in such a manner that the current i fed in via movable lead rod 46, across electrodes 42 and 44 and fixed lead rod 28 to input terminal lead 22, is initially directed toward a connecting face 29 formed on the thick-walled top portion 48 at a same height as the input terminal lead 22 relative to the axis 72, for connection to an outer lead rod 50. Current i, and with it thermal current $I_w$, thus reach the upper, thick-walled top portion 48 of the molded coil body 21 over a very short path, as best shown in FIG. 3. Due to the dimensions there, only a very slight warm-up occurs.

The remainder of the coil body 21, below the thick-walled top portion 48, is a cylindrical side wall or side wall portion 54 which is symmetrical with respect to the axis 72 and has a generally uniform wall thickness which is less than that of the top portion 48. The vertical slot or gap 32 provided in the thick-walled top portion 48 assures that the current i is distributed over the entire height of the coil body such that the current flows in part in a partial loop through the part of the cylindrical side wall portion 54 at the level of the electrodes 42 and 44. The slot 32 extends from the peripheral surface 25 more than 180° and preferably about 360°, around the axis 72. The slot 32 bounds the input terminal lead portion 22 and extends both horizontally and vertically entirely through the side wall portion 54 and the peripheral surface 25, so as to interrupt the linear (straight line) electrical connection between the input terminal lead portion 22 and the connection face 29, and guides the current i in a circumferential counter-clockwise path adjacent the peripheral surface 25 to the connecting face 29 via an output terminal lead or lead portion 23 formed integrally with the top portion 48 of the coil body 21. Although the connecting face 29, which is formed as an end face of the output terminal lead portion 23, is shown recessed in the bell-shaped coil body 21, it could alternatively be provide on a raised portion extending from the peripheral surface 25.

FIG. 2 also shows that the molded coil body 21 according to the invention is able to very advantageously cover also the sharp-edged soldered flange 30 between the insulating cylinder 31 and metal cylinder 24, so that the voltage stability of the switch is improved in spite of the larger diameter of the coil body 21. Rounding upper and lower end portions 26 and 27 of the peripheral surface 25 of the coil body 21 also contributes to an increase in insulating capability. The rounded lower end portion 27 is formed on a lip 56 at the lower end of the cylindrical wall portion 54. Preferably the radius of curvature of the lower end portion 27 is greater than the thickness of the cylindrical side wall portion 54 adjacent thereto.

If needed, existing vacuum switches can be retrofit with the magnetic coil according to the invention.

Figure 4:
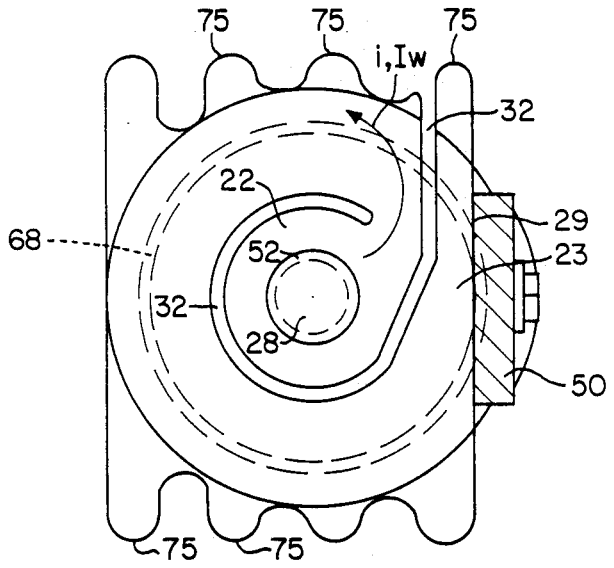
FIG. 4 is a top view of a coil body provided with cooling fins.

In order to generate the axial magnetic field in the contact gap between electrodes 42 and 44, it may be advantageous to increase the current density in the thin-walled cylindrical side wall portion 54 of the coil body 21. This can be accomplished by providing holes, slots or some other suitable configuration in jacket 25 in the vicinity of input terminal lead 22 and possibly also in the vicinity of the connecting face 29, without thus reducing the heat carrying capacity of the coil body 21. The slots 32 may be filled with a poorly electrically conductive or insulating material so as to increase voltage stability and improve heat dissipation from the vacuum switch via the bell-shaped coil body 21. The thermal equilibrium can also be improved by providing cooling fins 75 on the exterior of the coil body 21, as shown in FIG. 4.

It will be understood that the above description of the present invention is susceptible to various modifications, changes and adaptations, and the same are intended to be comprehended within the meaning and range of equivalents of the appended claims.

What is claimed is:

1. A vacuum switch, comprising:

a housing enclosing a vacuum chamber, the housing including:

a metal cylinder having opposite first and second ends, an insulating cylinder axially aligned with said metal cylinder and having a first end and a second end, said first end of said insulating cylinder being hermetically sealed to said second end of said metal cylinder, a first end wall closing said first end of said metal cylinder, and a second end wall closing said second end of said insulating cylinder;

a stationary electrode and a movable electrode, said stationary electrode and movable electrode being disposed in said vacuum chamber and surrounded by said metal cylinder;

two electrode lead rods, including a stationary electrode lead rod fixed to the stationary electrode and a movable electrode lead rod fixed to said movable electrode, one of said two electrode lead rods projecting from said chamber through said first end wall, the other of said two electrode lead rods projecting oppositely to said one electrode lead rod through said second end wall;

an input terminal lead;

an output terminal lead; and a magnetic coil having a bell-shaped molded coil body made of an electrically and thermally conductive material, said coil body having a top portion above said first end wall, a side wall portion surrounding said metal cylinder, and an approximately bell-shaped peripheral surface bounding said top and side wall portions, said top portion having a thickness which is greater than a thickness of said side wall portion, said input and output terminal leads being enclosed by said peripheral surface, said input terminal lead connecting said top portion with the one electrode lead rod above said one end wall, said output terminal lead being connected to said coil body so that at least a portion of a current in said one lead rod passes successively through said input terminal lead, said magnetic coil and said output terminal lead.

2. A vacuum switch as in claim 1, wherein said top portion comprises means for directing the at least a portion of the current in the magnetic coil at least partially around said metal cylinder in said side wall portion.

3. A vacuum switch as in claim 1, wherein said input terminal lead is formed integrally with a central portion of said top portion of said coil body, said coil body having a gap formed through said top portion, said gap separating said input terminal lead and output terminal lead, said gap extending between said input terminal lead and said output terminal lead from a first end which terminates in said peripheral surface, and continues concentrically about said input terminal lead through an angle of at least 180°.

4. A vacuum switch as in claim 3, further comprising an electrically poorly conducting or insulating material fully or partially filling said gap.

5. A vacuum switch as in claim 1, wherein said one electrode lead rod is said stationary electrode lead rod.

6. A vacuum switch as in claim 5, wherein said input terminal lead is threadedly connected to said stationary electrode lead rod.

7. A vacuum switch as in claim 1, wherein said metal cylinder and said insulating cylinder are aligned along an axis, said output terminal lead being formed integrally with said coil body and having a end face which forms a connecting face; said connecting face and said input terminal lead being disposed at a same height relative to said axis.

8. A vacuum switch as in claim 7, wherein said output terminal lead terminates with a connecting face recessed in said coil body relative to said peripheral surface.

9. A vacuum switch as in claim 1, wherein said metal cylinder and said insulating cylinder are hermetically sealed with a soldered flange and said side wall portion covers said soldered flange.

10. A vacuum switch as in claim 1, further comprising cooling fins on said peripheral surface of said coil body.

11. A vacuum switch as in claim 1, wherein said peripheral surface is rounded in an upper region of said top portion and at a lower end of said side wall portion.

12. A vacuum switch as in claim 1, wherein said side portion is cylindrical and has an axis colinear with said first electrode lead rod, said input terminal lead rod connecting said one of said two lead rods with said top portion at a first location adjacent said axis, said output terminal lead rod being connected to said top portion at a second location which is radially outward of said first location with respect to said axis.

13. A magnetic coil device for dispersing an arc between electrodes of a vacuum switch evenly across opposing faces of the electrodes, the vacuum switch having an electrode lead rod connected to one of the electrodes and projecting from a vacuum chamber of the switch, the magnetic coil device comprising:

a bell-shaped molded coil body made of an electrically and thermally conductive material, said molded coil body including a top portion and a cylindrical side wall projecting down from said top portion symmetrically with respect an axis to surround a metal cylinder of the vacuum switch within which the electrodes are disposed, said coil body having an approximately bell-shaped peripheral surface which bounds said top portion and said side wall; and input and output terminal leads disposed in said top portion and enclosed by said peripheral surface, said input terminal lead being disposed radially inward of both said coil body and said output terminal lead with respect to said axis and having means for connecting thereto an end of the electrode lead rod, said output terminal lead being connected at one end thereof to said top portion so that at least a portion of a current in the electrode lead rod passes successively through said input terminal lead, said coil body, and said output terminal lead, to said connecting face, said top portion having a thickness which is greater than a thickness of said side wall.

14. A magnetic coil device as in claim 13, wherein said top portion comprises means for directing the at least a portion of the current through said side wall along a path extending at least partially around said axis.

15. A magnetic coil device as in claim 13, wherein said side wall has a rounded lower end and said top portion has a rounded upper end.

16. A magnetic coil device as in claim 13, wherein said input and output terminal leads are formed integrally with said molded coil body, said input terminal lead being disposed along said axis, said means for connecting including an axially extending hole in input terminal lead for receiving the end of the electrode lead rod, said molded coil body comprises a gap formed through said top portion and said side portion, between said input terminal lead and said output terminal lead, said gap extending from an end which terminates in said peripheral surface, and continuing concentrically about said input terminal lead through an angle of at least 180°, so as to direct at least a portion of a current in said input terminal lead through said side wall through an angle of at least 180°, to said output terminal lead, said output terminal lead having said connecting face formed thereon, said output terminal lead connecting a portion of said coil body radially outside of said gap with said connecting face.

* * * * *